US010629991B2

(12) United States Patent
Lee et al.

(10) Patent No.: US 10,629,991 B2
(45) Date of Patent: Apr. 21, 2020

(54) ANTENNA DEVICE INCLUDING MUTUALLY COUPLED ANTENNA ELEMENTS

(71) Applicant: Samsung Electronics Co., Ltd., Suwon-si (KR)

(72) Inventors: JaeChun Lee, Seoul (KR); Sang Joon Kim, Hwaseong-si (KR); Joonseong Kang, Suwon-si (KR); Junyeub Suh, Suwon-si (KR); Wonseok Lee, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 54 days.

(21) Appl. No.: 15/978,289

(22) Filed: May 14, 2018

(65) Prior Publication Data

US 2019/0097321 A1 Mar. 28, 2019

(30) Foreign Application Priority Data

Sep. 25, 2017 (KR) ..... 10-2017-0123515

(51) Int. Cl.
*H01Q 7/00* (2006.01)
*H01Q 19/24* (2006.01)
(Continued)

(52) U.S. Cl.
CPC ..... *H01Q 7/005* (2013.01); *H01Q 1/24* (2013.01); *H01Q 1/36* (2013.01); *H01Q 1/50* (2013.01);
(Continued)

(58) Field of Classification Search
CPC .. H01Q 1/24; H01Q 1/36; H01Q 1/50; H01Q 21/00; H01Q 21/0006; H01Q 7/005;
(Continued)

(56) References Cited

U.S. PATENT DOCUMENTS 2,130,912 A * 9/1938 Tolson ..... G01S 1/02 342/428
3,475,756 A * 10/1969 Martino ..... H01Q 21/245 343/743
(Continued)

FOREIGN PATENT DOCUMENTS

JP 4831252 B1 12/2011
JP 2012-147243 A 8/2012
(Continued)

OTHER PUBLICATIONS

Shoamanesh, A. et al., "Multiply Driven and Loaded Coaxial Circular Loop Arrays", *IEEE Transactions on Antennas and Propagation*, vol. 28, Issue: 2, Mar. 1980 (pp. 255-258).
(Continued)

*Primary Examiner* — Tho G Phan
(74) *Attorney, Agent, or Firm* — NSIP Law

(57) ABSTRACT

An antenna device is disclosed. The antenna device includes a main antenna element and a sub antenna element, the sub antenna element being configured to form a mutual coupling with the main antenna element where a central axis of the sub antenna element forms an angle different from a right angle with a central axis of the main antenna element.

25 Claims, 34 Drawing Sheets

(51) Int. Cl.

| | |
|---|---|
| ***H01Q 21/29*** | (2006.01) |
| ***H01Q 1/24*** | (2006.01) |
| ***H01Q 1/36*** | (2006.01) |
| ***H01Q 1/50*** | (2006.01) |
| ***H01Q 21/00*** | (2006.01) |

(52) U.S. Cl.
CPC ..... *H01Q 19/24* (2013.01); *H01Q 21/0006* (2013.01); *H01Q 21/29* (2013.01)

(58) Field of Classification Search
CPC ..... H01Q 19/24; H01Q 21/29; H01Q 7/00; H01Q 9/04; H01Q 9/28; H01Q 9/285
See application file for complete search history.

(56) References Cited

U.S. PATENT DOCUMENTS

| | | | | |
|---|---|---|---|---|
| 4,012,742 | A * | 3/1977 | Dempsey | H01Q 7/00 343/742 |
| 5,966,100 | A * | 10/1999 | Podger | 343/742 |
| 6,304,230 | B1 | 10/2001 | Panther et al. | |
| 7,505,009 | B2 * | 3/2009 | Parsche | H01Q 7/00 343/742 |
| 7,852,276 | B2 | 12/2010 | Apostolos | |
| 2009/0289864 | A1 | 11/2009 | Derneryd et al. | |
| 2016/0043467 | A1 | 2/2016 | Desclos et al. | |

FOREIGN PATENT DOCUMENTS

| | | | |
|---|---|---|---|
| JP | 2017-59982 | A | 3/2017 |
| KR | 10-2006-0029828 | A | 4/2006 |
| KR | 10-2011-0005452 | A | 1/2011 |

OTHER PUBLICATIONS

Wei, Li Le et al. "Various Collocated Circular Loop Antennas: Theory, Analysis and Design", *2004 Asia-Pacific Radio Science Conference, 2004. Proceedings*, 2014 (pp. 9-12).

Nagar, Jogender et al., "Analytical Expressions for the Mutual Coupling of Loop Antennas Valid From the RF to Optical Regimes", *IEEE Transactions on Antennas and Propagation*, vol. 65, Issue 12, Dec. 2017, (pp. 6889-6903).

Extended European Search Report dated Feb. 19, 2019 in counterpart European Patent Application No. 18194313.5 (11 pages in English).

* cited by examiner

ANTENNA DEVICE INCLUDING MUTUALLY COUPLED ANTENNA ELEMENTS

CROSS-REFERENCE TO RELATED APPLICATIONS

This application claims the benefit under 35 USC § 119(a) of Korean Patent Application No. 10-2017-0123515 filed on Sep. 25, 2017, in the Korean Intellectual Property Office, the entire disclosure of which is incorporated herein by reference for all purposes.

BACKGROUND

1. Field

The following description relates to an antenna device.

2. Description of Related Art

With the development of communication technology such as, for example, short-range wireless communication, Bluetooth, and wireless power transfer technology, an electronic device or an implantable device inserted in a living body may need an antenna device that is small in size and configured to stably transmit and receive signals in all directions.

Using a plurality of antenna modules, wireless signal and power transmission and reception may be enabled in various directions. However, connecting the antenna modules may be difficult, and the cost of manufacture may rise due to additional components.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, there is provided an antenna device including a main antenna element configured to form a mutual coupling with a sub antenna element, in response to power being supplied to the main antenna element, and the sub antenna element being configured to form the mutual coupling with the main antenna element where a central axis of the sub antenna element forms an angle different from a right angle with a central axis of the main antenna element.

The angle may include determined based on a mutual coupling coefficient for the main antenna element and the sub antenna element.

A plane on which the main antenna element is arranged and a plane on which the sub antenna element is arranged may form an angle calculated based on a mutual coupling coefficient.

The mutual coupling coefficient may be determined based on an impedance of the main antenna element, a resistance of the sub antenna element, and an impedance of the sub antenna element.

The sub antenna element may be configured to allow a current with a phase delayed by 90° degrees from a phase of a current flowing in the main antenna element to flow in the sub antenna element, in response to the mutual coupling with the main antenna element.

The main antenna element and the sub antenna element may have the same resistance, reactance, and size, and the sub antenna element may be configured to allow a current with a magnitude equal to a magnitude of a current flowing in the main antenna element to flow in the sub antenna element, in response to the mutual coupling with the main antenna element.

The main antenna element and the sub antenna element may be arranged to prevent an electrical contact between the main antenna element and the sub antenna element.

The main antenna element and the sub antenna element may be loop-type antennas.

The main antenna element and the sub antenna element may be dipole-type antennas.

The sub antenna element may be a plurality of antennas arranged to form the mutual coupling with the main antenna element.

The antenna device may include a feeder configured to supply power directly to the main antenna element through a wired connection.

The antenna device may include a feeder configured to supply power to the main antenna element through a mutual coupling.

The sub antenna element may be antennas arranged to form the mutual coupling with the main antenna element, wherein the feeder may be configured to form a mutual coupling with at least one of the main antenna element or the antennas.

The antenna device may include a communicator configured to form a mutual coupling with the main antenna element and to transfer a signal to the main antenna element through the mutual coupling, and a fixer configured to fix the communicator to a space corresponding to a center of the main antenna element and the sub antenna element.

The sub antenna element may be a loop-type antenna, and a capacitor.

A capacitance of the capacitor may be determined based on a resonant frequency of the mutual coupling formed between the main antenna element and the sub antenna element, and on an inductance of the loop-type antenna.

The sub antenna element may be a dipole-type antenna, and an inductor.

An inductance of the inductor may be determined based on a resonant frequency of the mutual coupling formed between the main antenna element and the sub antenna element, and on a capacitance of the dipole-type antenna.

The main antenna element may be a first impedance matcher configured to change an impedance of the main antenna element.

The main antenna element may be configured to generate a magnetic field in a first direction, and the sub antenna element may be configured to generate a magnetic field in a second direction that is orthogonal to the first direction.

The central axis of the main antenna element may correspond to a normal vector of a plane on which the main antenna element is disposed.

The central axis of the sub antenna element may correspond to a normal vector of a plane on which the sub antenna element is disposed.

The capacitor may be configured to allow a current with a phase delayed by 90° from a phase of a current flowing in the main antenna element to flow in the sub antenna element.

The sub antenna element may be a second impedance matcher configured to change an impedance of the sub antenna element.

In another general aspect, there is provided an antenna device including a main antenna element configured to form a mutual coupling with each of a plurality of antennas, in response to power being supplied to the main antenna element, the each of the plurality of antennas are connected to respective reactance components, and a central axis of the each of the plurality of antennas forms an angle different from a right angle with a central axis of the main antenna element, wherein the mutual coupling is based on the angle between the central axis of the respective antenna of the antennas and the central axis of the main antenna element and the reactance value of the reactance component of the respective antenna.

The antenna device may include a feeder configured to form a mutual coupling with at least one of the main antenna element or the plurality of the antennas.

Other features and aspects will be apparent from the following detailed description, the drawings, and the claims.

Figure 1:
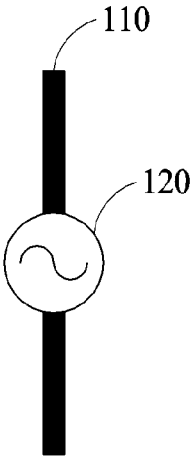
FIGS. 1 and 2 are diagrams illustrating examples of types of antenna elements.

Throughout the drawings and the detailed description, unless otherwise described or provided, the same drawing reference numerals will be understood to refer to the same elements, features, and structures. The drawings may not be to scale, and the relative size, proportions, and depiction of elements in the drawings may be exaggerated for clarity, illustration, and convenience.

DETAILED DESCRIPTION

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween. As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Also, in the description of embodiments, detailed description of well-known related structures or functions will be omitted when it is deemed that such description will cause ambiguous interpretation of the present disclosure.

Figure 2:
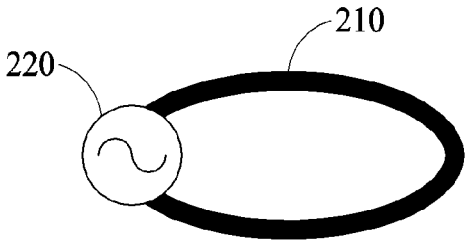

FIGS. 1 and 2 are diagrams illustrating examples of types of antenna elements.

Referring to FIGS. 1 and 2, antenna elements 110 and 210 are elements used to transmit or receive an electromagnetic wave in a certain band. The antenna elements 110 and 210 used herein may be, for example, resonator antennas. When such a resonator antenna transmits or receives an electromagnetic wave, a current signal, a voltage signal, and the like that flow in wires included in the resonator antenna may be indicated by a standing wave pattern.

In an example, the antenna elements 110 and 210 may receive electromagnetic waves radiated from an external source, or externally radiate electromagnetic waves when power is supplied by feeders 120 and 220. For example, types of antenna elements may be classified into a dipole type as illustrated as the antenna element 110 of FIG. 1, and a loop type as illustrated as the antenna element 210 of FIG. 2.

Referring to FIG. 1, the dipole-type antenna element 110 refers to an antenna element in which the feeder 120 is connected in a wire. Although the feeder 120 is illustrated as being arranged at a center of the wire, an arrangement of the feeder 120 is not limited to the illustrative example.

Referring to FIG. 2, the loop-type antenna element 210 refers to an antenna element in which a wire connected to the feeder 220 is in a loop form. Although a circular loop is illustrated in FIG. 2, a loop is not limited to the illustrative example, and the loop may be provided in other forms, such as, for example, the wire maybe wound several times to be square-shaped, triangular-shaped, circular-shaped, or oval-shaped.

Figure 3:
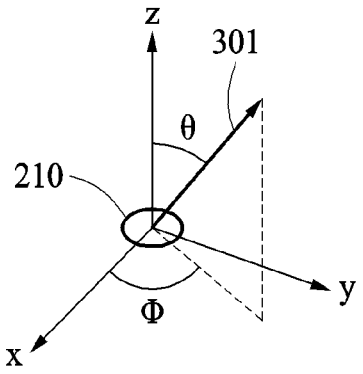
FIGS. 3 through 5 are diagrams illustrating examples of radiation of an antenna element.
Figure 4:
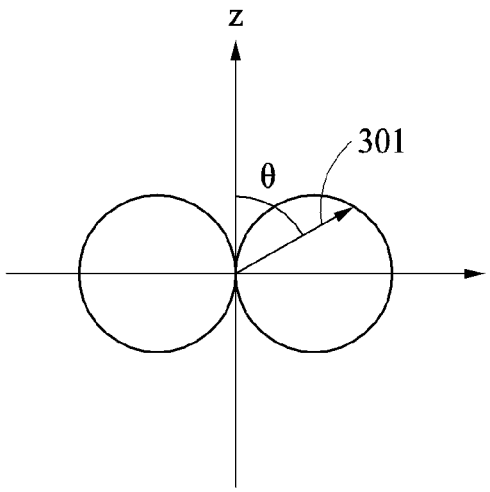
Figure 5:
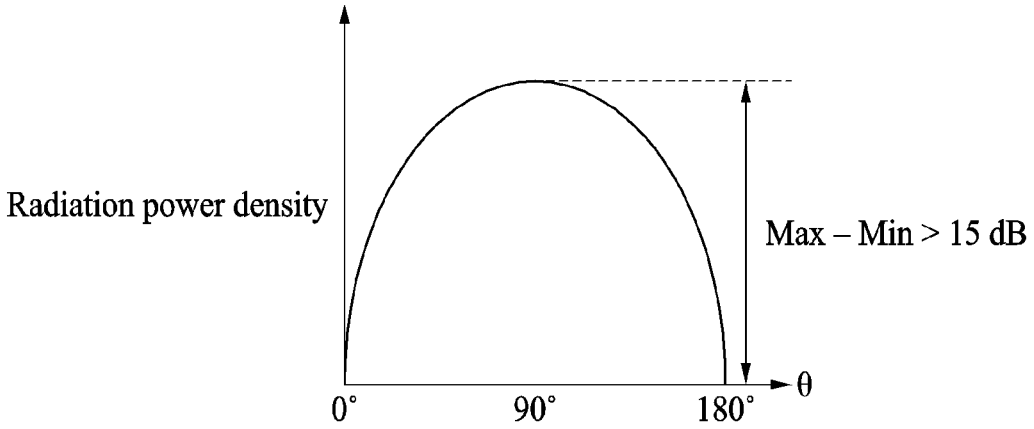

FIGS. 3 through 5 are diagrams illustrating examples of radiation of an antenna element.

FIG. 3 illustrates a structure in which the loop-type antenna element 210 of FIG. 2 is arranged on a xy plane for convenience of description. However, the structure is not limited to the illustrative example.

To describe radiation of the antenna element 210, a center of the antenna element 210 is illustrated as an origin in FIG. 3. In an example, a radiation pattern vector 301 is a vector indicating radiation in a direction from the antenna element 210.

In a polar coordinate system, an angle formed between the radiation pattern vector 301 and a z axis is indicated as θ, and an angle formed between the radiation pattern vector 301 and a xz plane is indicated as ϕ. Here, the angles θ and ϕ formed by the radiation pattern vector 301 with respect to the origin indicate radiation directions, and a magnitude of the radiation pattern vector 301 indicates radiation power.

In a rectangular coordinate system, a magnitude of the radiation pattern vector 301 indicates radiation power, and a direction of the radiation pattern vector 301 indicates a radiation direction.

FIG. 4 illustrates an example of a radiation power density, for example, a radiation pattern, based on a direction. Referring to FIG. 4, a horizontal axis corresponds to an axis on a xy plane. The loop-type antenna element 210 illustrated in FIG. 3 may have doughnut-shaped radiation patterns symmetrical to each other based on a z axis as illustrated in FIG. 4.

FIG. 5 is a graph illustrating an example of a radiation pattern illustrated in FIG. 4 with respect to θ. As illustrated in FIG. 5, radiation power in a direction where θ is 0° and a direction where θ is 180° may be reduced or attenuated by 15 decibels (dB) or greater, compared to radiation power in a direction where θ is 90°. Although not illustrated, radiation power of radiation by the dipole-type antenna element 110 illustrated in FIG. 1 may also be reduced by 15 dB or greater with respect to a certain angle.

FIGS. 6 through 9 are diagrams illustrating examples of two loop-type antenna elements orthogonal to each other, and radiation of the antenna elements.

Figure 6:
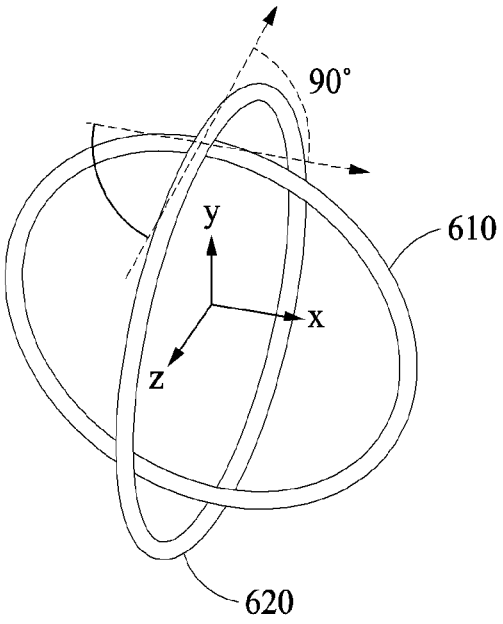
FIGS. 6 through 9 are diagrams illustrating examples of two loop-type antenna elements orthogonal to each other, and radiation of the antenna elements.

FIG. 6 illustrates an example of an antenna device in which two loop-type antenna elements are arranged to be orthogonal to each other. Referring to FIG. 6, a first antenna element 610 and a second antenna element 620 may be elements having same characteristics, for example, size, resistance, and quality factor. For convenience of description, the first antenna element 610 is illustrated as being arranged on a xy plane and the second antenna element 620 is illustrated as being arranged on a yz plane. However, the arrangements are not limited to the illustrative example, and other arrangements may be used without departing from the spirit and scope of the illustrative examples described.

Figure 7:
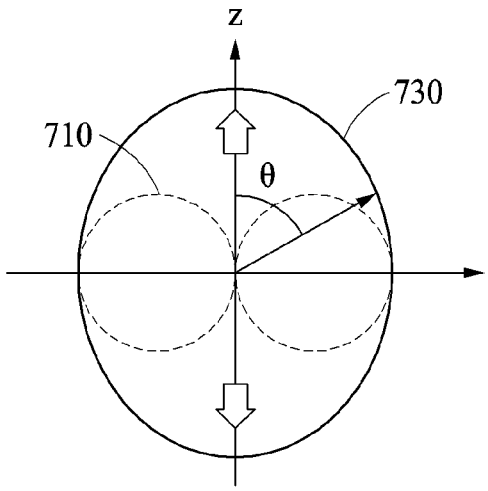

The antenna elements 610 and 620 arranged as illustrated in FIG. 6 may have radiation patterns as illustrated in FIG. 7. The antenna element 610, on its own, may have the radiation pattern 710, as shown in FIG. 7. However, the first antenna element 610 and the second antenna element 620 may complement each other in a direction in which radiation power is reduced. In FIG. 5, radiation power of radiation formed by the first antenna element 610 is reduced in a direction where θ is 0° and a direction where θ is 180°. However, in FIG. 7, the radiation power in the direction where θ is 0° and the direction where θ is 180° may be complemented by the second antenna element 620.

Figure 8:
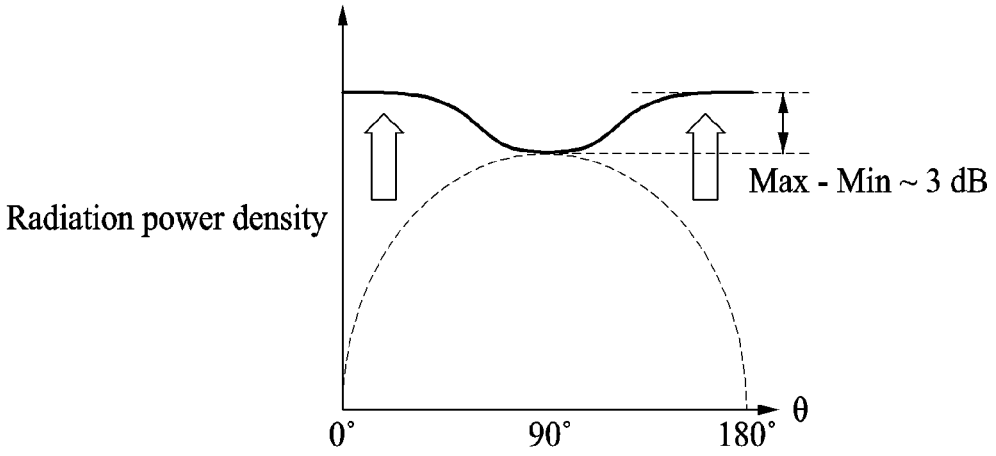

Referring to FIG. 7, an antenna device including the first antenna element 610 and the second antenna element 620 may have a radiation pattern with radiation power 730 that is uniform in all directions. Referring to FIG. 8, the antenna device including the first antenna element 610 and the second antenna element 620 may have a radiation pattern with a radiation power difference of approximately 3 dB.

Figure 9:
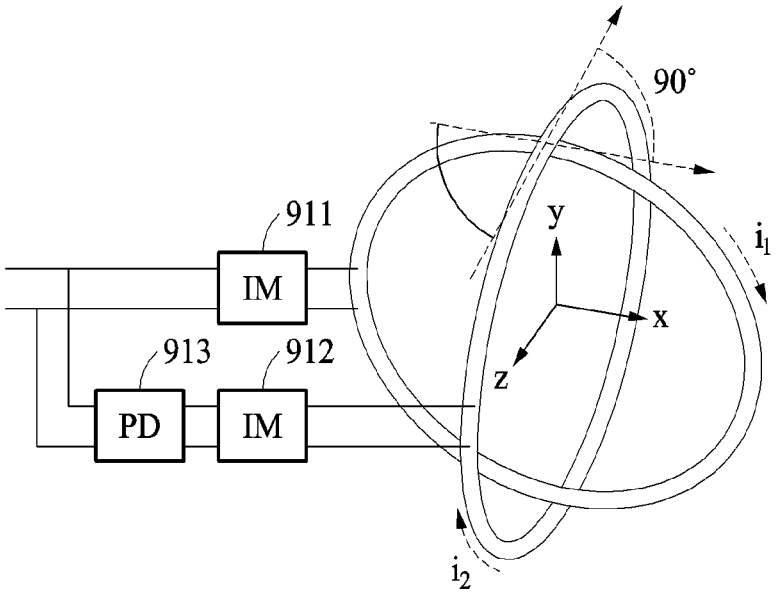

Referring to FIG. 9, the antenna device includes impedance matchers IMs 911 and 912 that match respective impedances of the first antenna element 610 and the second antenna element 620. In addition, the antenna device delays a phase of a current $i_2$ flowing in the second antenna element 620 through a phase delayer PD 913. For example, the antenna device may determine a phase difference between a current $i_1$ flowing in the first antenna element 610 and the current $i_2$ flowing in the second antenna element 620 to be 90° as represented by Equation 1.

$$\angle\frac{i_2}{i_1} = 90° \quad \text{[Equation 1]}$$

Thus, the antenna device may feed or supply currents having a phase difference of 90° to antenna elements orthogonal to each other, thereby generating circular polarization.

Figure 10:
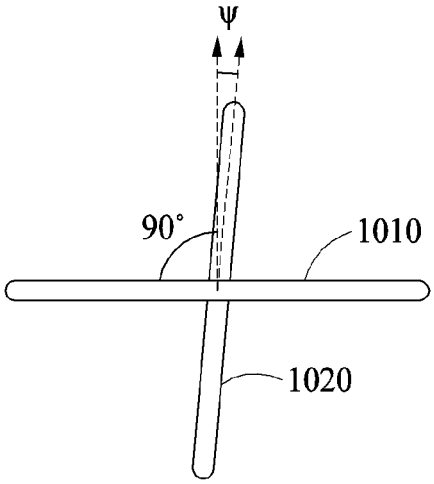
FIGS. 10 and 11 are diagrams illustrating examples of an arrangement of loop-type antenna elements.
Figure 11:
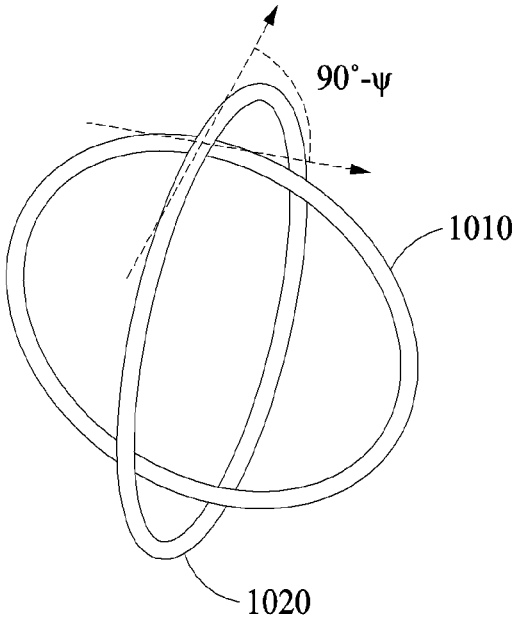

FIGS. 10 and 11 are diagrams illustrating examples of an arrangement of loop-type antenna elements.

FIG. 10 is a top view of an arrangement of loop-type antenna elements. FIG. 11 is a perspective view of the arrangement of the loop-type antenna elements. Referring to FIGS. 10 and 11, in an example, a plane on which a first antenna element 1010 is arranged and a plane on which a second antenna element 1020 is arranged may form an angle different from a right angle. Thus, the first antenna element 1010 and the second antenna element 1020 may be arranged such that a central axis of the first antenna element 1010 and a central axis of the second antenna element 1020 may form an angle different from a right angle, or an angle at which the central axes are not orthogonal to each other. In an example, the central axis of the first antenna element 1010 and the central axis of the second antenna element 1020 may be nonparallel. In an example, the central axis of the first antenna element 1010 corresponds to a normal vector of the plane on which the first antenna element 1010 is arranged, and the central axis of the second antenna element 1020 corresponds to a normal vector of the plane on which the second antenna element 1020 is arranged.

The angle formed between the plane on which the first antenna element 1010 is arranged and the plane on which the second antenna element 1020 is arranged may be 90°−ψ. The plane on which first antenna element 1010 is arranged and the plane on which the second antenna element 1020 is arranged may be arranged to form an angle calculated based on a preset mutual coupling coefficient. Here, the angle formed between the central axis of the first antenna element 1010 and the central axis of the second antenna element 1020 may be 90°−ψ.

In an example, ψ denotes an angle formed between the plane on which the first antenna element 1010 is arranged and the central axis of the second antenna element 1020. In an example, ψ also denotes an angle formed between the plane on which the second antenna element 1020 is arranged and the central axis of the first antenna element 1010. Here, ψ may be determined based on a mutual coupling coefficient k that is required for the first antenna element 1010 and the second antenna element 1020. For example, ψ may be an angle greater than 0° and less than 90°.

The first antenna element 1010 and the second antenna element 1020 may also be arranged such that an angle formed between a direction of a radiation pattern of the first antenna element 1010 and a direction of a radiation pattern of the second antenna element 1020 is closer to a right angle, or substantially identical to a right angle. For example, the mutual coupling coefficient k may be designed to minimize ψ. Thus, the central axis of the first antenna element 1010 and the central axis of the second antenna element 1020 may form an angle that is slightly less than the right angle. Thus, the first antenna element 1010 may generate a magnetic field in a first direction, and the second antenna element 1020 may generate a magnetic field in a second direction similar to a direction orthogonal to the first direction.

In addition, the first antenna element 1010 and the second antenna element 1020 may be arranged to prevent an electrical contact between the first antenna element 1010 and the second antenna element 1020.

Figure 12:
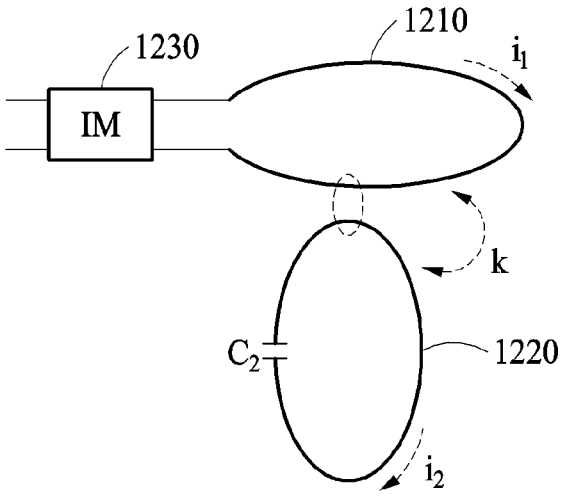
FIG. 12 is a diagram illustrating an example of a mutual coupling of antenna elements arranged as illustrated in FIGS. 10 and 11.

FIG. 12 is a diagram illustrating an example of a mutual coupling of antenna elements arranged as illustrated in FIGS. 10 and 11.

Referring to FIG. 12, an antenna device includes a first antenna element 1210, a second antenna element 1220, and an IM 1230. In an example, the first antenna element 1210 and the second antenna element 1220 are embodied as loop-type antennas. In such an example, the second antenna element 1220 may include a capacitor C2 as a reactance component.

The first antenna element 1210 and the second antenna element 1220 may be designed to form an angle that is slightly different from 90°, as illustrated in FIGS. 10 and 11. Such an arrangement of two antenna elements illustrated in FIGS. 10 and 11 may have a radiation pattern that is uniform in all directions, and generate a weak mutual coupling between the two antenna elements. Referring to FIG. 12, the first antenna element 1210 is connected to a feeder through the IM 1230, and the second antenna element 1220 is electrically connected to the first antenna element 1210 through a mutual coupling without a direct contact. To control the mutual coupling, a reactance element, for example, an inductor L or a capacitor C, may be connected to the second antenna element 1220. Although the reactance element is illustrated as a capacitor $C_2$ in FIG. 12, the reactance element is not limited to the illustrative example. The IM 1230 is connected to the first antenna element 1210 to match an impedance of the first antenna element 1210.

A reactance value of the reactance element, for example, the capacitor C2 in FIG. 12, may be designed such that a phase difference between currents flowing in the first antenna element 1210 and the second antenna element 1220 is 90°.

The first antenna element 1210 and the second antenna element 1220 may form the mutual coupling through the arrangement illustrated in FIGS. 10 and 11. For example, the first antenna element 1210 and the second antenna element 1220 may be arranged such that a central axis of the first antenna element 1210 and a central axis of the second antenna element 1220 form an angle of 90°−ψ, which is different from a right angle, 90°. The first antenna element 1210 and the second antenna element 1220 may form the mutual coupling corresponding to a mutual coupling coefficient k.

In an example, the antenna device may feed or supply power to the second antenna element 1220 through the mutual coupling between the first antenna element 1210 and the second antenna element 1220, instead of feeding or supplying power to the second antenna element 1220 through a direct wired connection. Thus, the antenna device may be embodied in a simple structure without a feedthrough point used to feed or supply power directly to the second antenna element 1220, while reducing a difference in radiation power in all directions.

Figure 13:
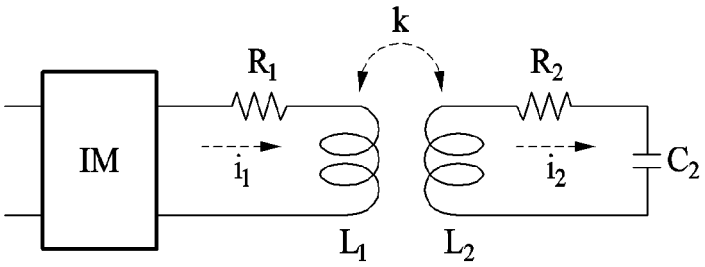
FIG. 13 is a diagram illustrating an example of an equivalent circuit of antenna elements arranged as illustrated in FIGS. 10 and 11.

FIG. 13 is a diagram illustrating an example of an equivalent circuit of antenna elements arranged as illustrated in FIGS. 10 and 11.

A mutual coupling of antenna elements illustrated in FIG. 12 may be embodied in an equivalent circuit illustrated in FIG. 13. Referring to FIG. 13, $R_1$ indicates a resistance of the first antenna element 1210 of FIG. 12, and $L_1$ indicates an inductance of the first antenna element 1210. $R_2$ indicates a resistance of the second antenna element 1220 of FIG. 12, $L_2$ indicates an inductance of the second antenna element 1220, and C2 indicates a capacitance of a reactance element connected to the second antenna element 1220. $i_1$ indicates a current supplied through an IM and flowing in the first antenna element 1210, and $i_2$ indicates a current induced through the mutual coupling and flowing in the second antenna element 1220. k indicates a mutual coupling coefficient, or a coefficient of the mutual coupling formed between the first antenna element 1210 and the second antenna element 1220. Equation 2 associated with the equivalent circuit illustrated in FIG. 13 may be represented as follows.

$$i_2\left(R_2 + j\omega L_2 + \frac{1}{j\omega C_2}\right) + i_1 j\omega k\sqrt{L_1 L_2} = 0 \quad \text{[Equation 2]}$$

In Equation 2, w denotes a frequency of power supplied through the IM. Equation 2 may also be expressed by Equation 3 by deriving a current ratio between the current $i_1$ of the first antenna element 1210 and the current $i_2$ of the second antenna element 1220 from Equation 2.

$$\frac{i_2}{i_1} = \frac{j\omega k\sqrt{L_1 L_2}}{R_2 + j\left(\omega L_2 - \frac{1}{\omega C_2}\right)} \quad \text{[Equation 3]}$$

For the first antenna element 1210 and the second antenna element 1220 to have radiation patterns that are uniform in all directions, a phase difference between the current $i_1$ of the first antenna element 1210 and the current $i_2$ of the second antenna element 1220 at a resonant frequency $f_0$ may be designed to be 90, and the current ratio between the currents $i_1$ and $i_2$ may be designed to be a, as represented by Equation 4 below. Thus, the second antenna element 1220 may allow a current with a phase delayed by 90° from a phase of a current flowing in the first antenna element 1210 to flow in the second antenna element 1220, in response to the mutual coupling with the first antenna element 1210. A current magnitude or amplitude ratio may be determined based on a type and a size of the first antenna element 1210 and the second antenna element 1220. Here, a magnitude of a current may also be construed as indicating amplitude of the current, or the terms 'magnitude' and 'amplitude' maybe used interchangeably herein.

For example, to form radiation power that is uniform in all directions, radiation power of the first antenna element 1210 of the antenna device and radiation power of the second antenna element 1220 of the antenna device may need to be equal to each other. When the two antenna elements 1210 and 1220 included in the antenna device are the same in type and size, radiation power based on magnitudes of currents of the two antenna elements 1210 and 1220 may also be the same, and thus the magnitudes of the currents flowing in the two antenna elements 1210 and 1220 may be designed to be equal to each other. However, when the two antenna elements 1210 and 1220 are different in type and size, radiation power based on a magnitude of a current of each of the antenna elements 1210 and 1220 may be estimated based on a simulation of each of the antenna elements 1210 and 1220. Thus, when the two antenna elements 1210 and 1220 are different in type and size, the current amplitude ratio a may be set such that the radiation power of the first antenna element 1210 and the radiation power of the second antenna element 1220 are equal to each other based on a result of the simulation.

$$\frac{i_2}{i_1} = a\angle 90° \text{ at } \omega = \omega_0 = 2\pi f_0 \quad \text{[Equation 4]}$$

A mutual coupling coefficient k and a capacitance $C_2$ that satisfy constraints of Equation 4 above may be derived as represented by Equation 5.

$$\begin{cases} k = \dfrac{aR_2}{\omega_0\sqrt{L_1 L_2}} \\ C_2 = \dfrac{1}{\omega_0^2 L_2} \end{cases} \quad \text{[Equation 5]}$$

As represented by Equation 5, the mutual coupling k may be determined based on the current ratio a, a resonant frequency $w_0$, the resistance $R_2$ of the second antenna element 1220, the inductance $L_2$ of the second antenna element 1220, and the inductance $L_1$ of the first antenna element 1210. The capacitance $C_2$ of the capacitor included in the second antenna element 1220 may be determined based on the resonant frequency $w_0$ and the inductance $L_2$ of the second antenna element 1220.

In an example, an angle formed between a central axis of the first antenna element 1210 and a central axis of the second antenna element 1220 is determined based on a mutual coupling coefficient required for the first antenna element 1210 and the second antenna element 1220. For example, the angle may be determined based on the mutual coupling coefficient k as represented by Equation 5. For example, a mutual coupling coefficient k for antenna elements may be derived from Equation 5, and an angle that satisfies the derived mutual coupling coefficient k may be determined among angles formed between central axes of the antenna elements through simulations.

Figure 14:
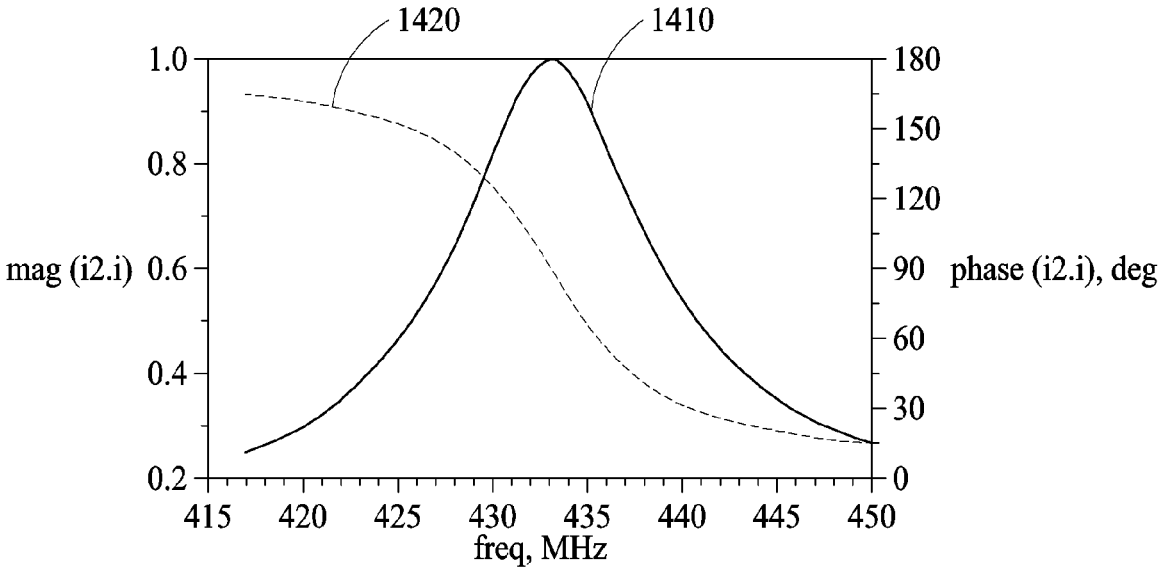
FIG. 14 is a graph illustrating an example of a phase difference and a current ratio between currents flowing in antenna elements arranged as illustrated in FIGS. 10 and 11.

FIG. 14 is a graph illustrating an example of a phase difference and a current ratio between currents flowing in antenna elements arranged as illustrated in FIGS. 10 and 11.

For example, when the first antenna element 1210 and the second antenna element 1220 of FIG. 12 are the same in size and characteristics, constraints as indicated in Equation 6 may be set in association with Equation 3. For example, the first antenna element 1210 and the second antenna element 1220 may be the same in type and size, and have the same resistance and reactance.

$$\text{When } L_1 = L_2,\ \frac{i_2}{i_1} = 1\angle 90° \text{ where } Q = \frac{\omega_0 L_1}{R_1} = \frac{\omega_0 L_2}{R_2} \quad \text{[Equation 6]}$$

In Equation 6, Q denotes a quality factor corresponding to an antenna characteristic. A mutual coupling coefficient k and a capacitance $C_2$ that satisfy Equation 3 and the constraints of Equation 6 may be derived as represented by Equation 7.

$$kQ = 1 \quad \text{[Equation 7]}$$
$$C_2 = \frac{1}{\omega_0^2 L_2}$$

Thus, when the two antenna elements 1210 and 1220 have the same characteristic, the mutual coupling coefficient k may be designed to be a value corresponding to a reciprocal of the quality factor Q. The capacitance $C_2$ may be determined based on the resonant frequency $w_0$ and the inductance $L_2$ of the second antenna element 1220.

The antenna device designed to satisfy Equation 7 above may have a simulation result illustrated in FIG. 14. FIG. 14 illustrates a frequency response at a resonant frequency of 433 megahertz (MHz). At the resonant frequency of 433 MHz, a current ratio 1410

$$\left|\frac{i_2}{i_1}\right|$$

between currents flowing in two antenna elements, for example, the two antenna elements 1210 and 1220, may be 1, indicating that magnitudes of the currents are equal to each other. In addition, a phase difference 1420

$$\angle\frac{i_2}{i_1}$$

between the currents may be measured at 90°. In response to the mutual coupling with the first antenna element 1210, the second antenna element 1220 may allow a current of a same magnitude as a current flowing in the first antenna element 1210 to flow in the second antenna element 1220.

Figure 15:
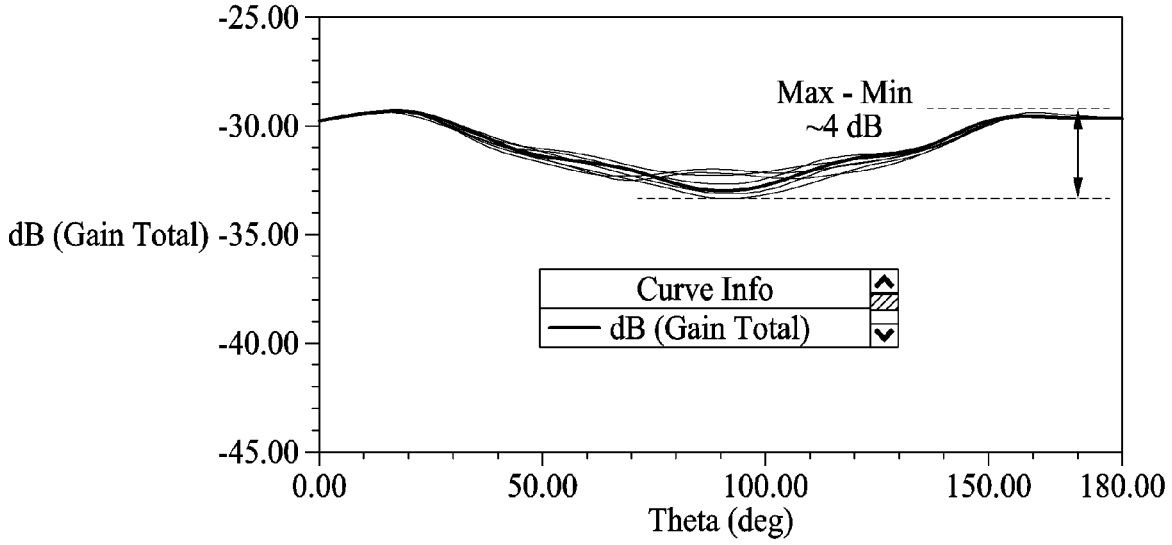
FIG. 15 is a graph illustrating an example of radiation of an antenna device including antenna elements.

FIG. 15 is a graph illustrating an example of radiation of an antenna device including antenna elements.

FIG. 15 illustrates a result of simulations of radiation, in all directions, of a first antenna element and a second antenna element that are arranged at an angle different from a right angle.

For example, a line width of a wire included in each of the antenna elements is 0.4 millimeters (mm), and a material of the wire is brass. The first antenna element and the second antenna element may be arranged such that an angle formed between a central axis of the first antenna element and a central axis of the second antenna element is 84°. A capacitance $C_2$ of a capacitor connected to the second antenna element may be designed to be 4.7 picofarad (pF). An inductance L of each of the antenna elements may be 30 nanohenry (nH), and a quality factor Q may be 40.

FIG. 15 also illustrates a result of a simulation in which the antenna device supplies power only to the first antenna element at a resonant frequency of 433 MHz. As illustrated, a radiation power difference in radiation power of the first antenna element and the second antenna element in all directions is approximately 4 dB.

Figure 16:
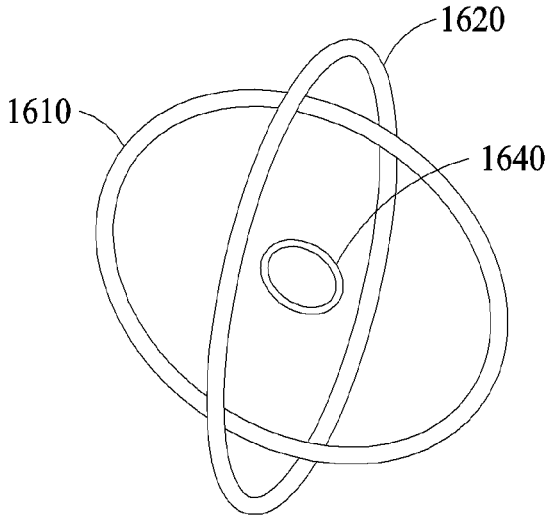
FIG. 16 is a diagram illustrating an example of an antenna device including a structure configured to supply power through a mutual coupling to antenna elements arranged as illustrated in FIGS. 10 and 11.

FIG. 16 is a diagram illustrating an example of an antenna device including a structure configured to supply power through a mutual coupling to antenna elements arranged as illustrated in FIGS. 10 and 11.

Referring to FIG. 16, as similar to the arrangement illustrated in FIGS. 10 and 11, a first antenna element 1610 and a second antenna element 1620 are arranged such that a central axis of the first antenna element 1610 and a central axis of the second antenna element 1620 form an angle different from a right angle, 90°, therebetween.

A feeder 1640 is arranged on a plane same as a plane on which the first antenna element 1610 is arranged. The feeder 1640 may supply power to the first antenna element 1610 through a mutual coupling. Through the mutual coupling, a direct connection between the feeder 1640 and the first antenna element 1610 is not needed, and thus inconvenience in manufacturing an antenna device and the number of elements needed for the antenna device may be reduced. A mutual coupling may also be formed between the feeder 1640 and the second antenna element 1620. However, strength of the mutual coupling between the feeder 1640 and the second antenna element 1620 may be insignificant, compared to that of the mutual coupling between the feeder 1640 and the first antenna element 1610.

Figure 17:
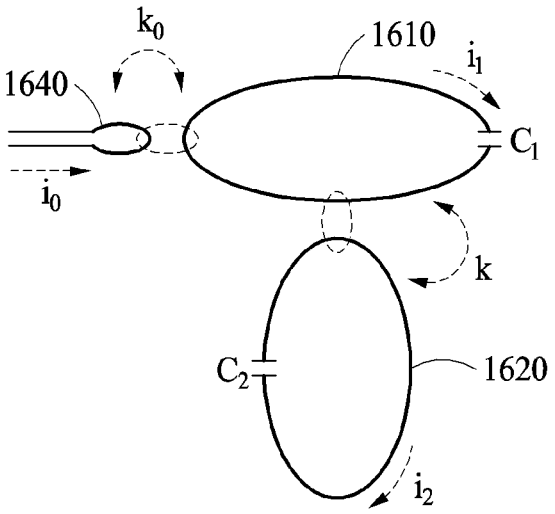
FIG. 17 is a diagram illustrating an example of a mutual coupling of antenna elements of the antenna device of FIG. 16.

FIG. 17 is a diagram illustrating an example of a mutual coupling of the antenna elements of the antenna device of FIG. 16.

The first antenna element 1610, the second antenna element 1620, and the feeder 1640 that are arranged as illustrated in FIG. 16 may form mutual couplings as illustrated in FIG. 17. For example, as illustrated, the feeder 1640 and the first antenna element 1610 forms a mutual coupling having a mutual coupling coefficient $k_0$, and $i_0$ used here indicates a current flowing in the feeder 1640. Also, the first antenna element 1610 and the second antenna element 1620 form a mutual coupling having a mutual coupling coefficient k. The first antenna element 1610 may be connected to a capacitor used as a reactance element to form the mutual coupling with the feeder 1640, and the capacitor has a capacitance $C_1$. The second antenna element 1620 may be connected to a capacitor used as a reactance element to form the mutual coupling with the first antenna element 1610, and the capacitor has a capacitance $C_2$.

Figure 18:
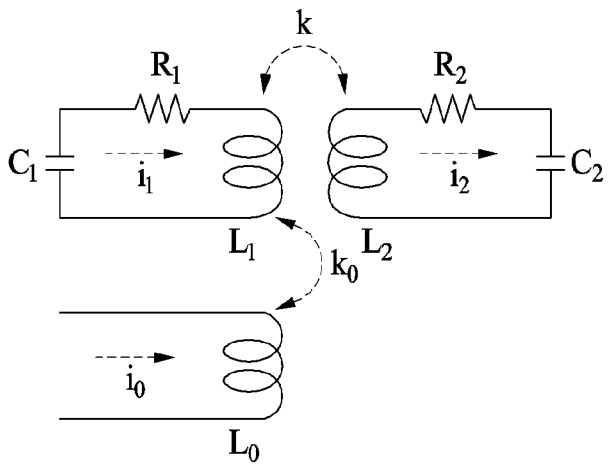
FIG. 18 is a diagram illustrating an example of an equivalent circuit of the antenna device of FIG. 16.

FIG. 18 is a diagram illustrating an example of an equivalent circuit of the antenna device of FIG. 16.

FIG. 18 illustrates an equivalent circuit through the mutual couplings of the first antenna element 1610, the second antenna element 1620, and the feeder 1640 illustrated in FIG. 17. Referring to FIG. 18, $L_0$ indicates an inductance of the feeder 1640, $R_1$ indicates a resistance of the first antenna element 1610, and $L_1$ indicates an inductance of the first antenna element 1610. Also, $R_2$ indicates a resistance of the second antenna element 1620, and $L_2$ indicates an inductance of the second antenna element 1620.

The mutual coupling coefficient k of the mutual coupling between the first antenna element 1610 and the second antenna element 1620, and the capacitance $C_2$ of the capacitor connected to the second antenna element 1620 may be derived based on equations described above with reference to FIG. 13.

Figure 19:
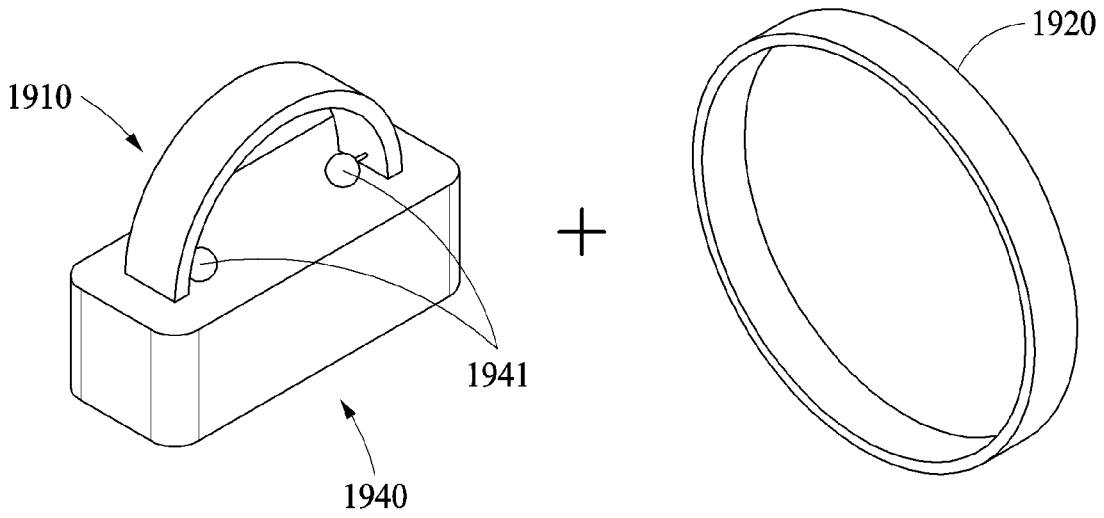
FIGS. 19 through 21 are diagrams illustrating examples of a connection between a feeder and antenna elements of an antenna device.
Figure 20:
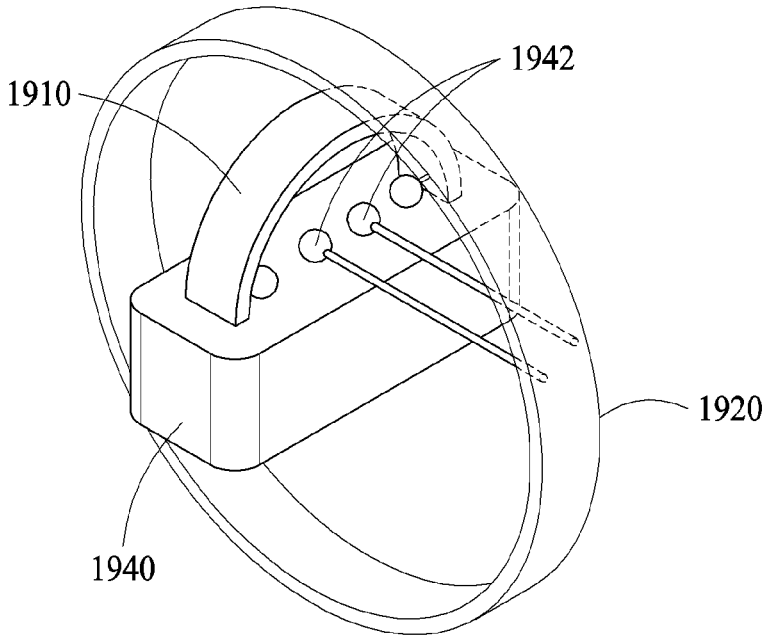
Figure 21:
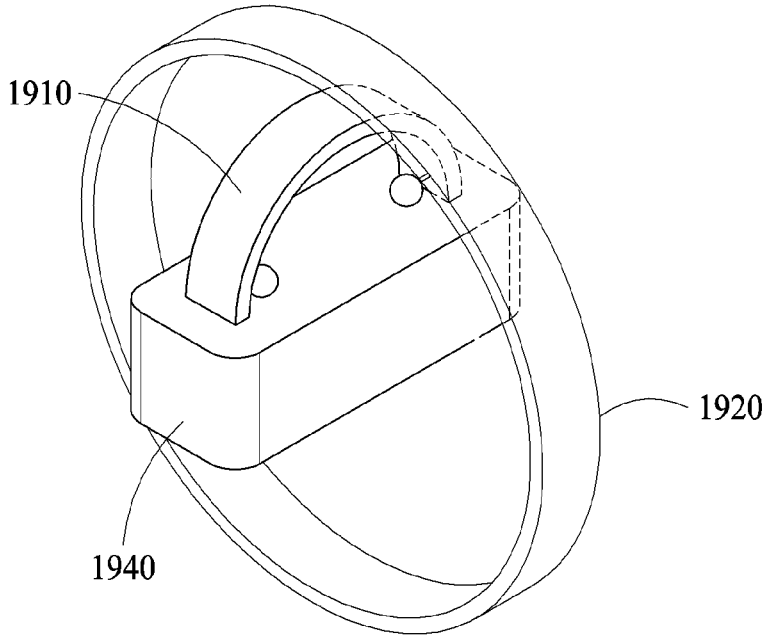

FIGS. 19 through 21 are diagrams illustrating examples of a connection between a feeder and antenna elements of an antenna device.

FIG. 19 illustrates an example of a structure in which a first antenna element 1910 is connected to a feeder 1940 through a feedthrough point 1941. The first antenna element 1910 may be electrically connected to a second antenna element 1920 through an arrangement illustrated in FIG. 20 or 21.

FIG. 20 illustrates an example of a structure in which the second antenna element 1920 is connected to the feeder 1940 through two additional feedthrough points 1942.

FIG. 21 illustrates a structure in which the first antenna element 1910 and the second antenna element 1920 are electrically connected through a mutual coupling without an additional feedthrough point, dissimilar to the structure illustrated in FIG. 20. Through the mutual coupling formed when a central axis of the first antenna element 1910 and a central axis of the second antenna element 1920 are arranged to form an angle different from a right angle, a fewer number of feedthrough points may be used. In addition, such a reduction in the number of feedthrough points used may lower a level of manufacturing difficulty and also reduce a manufacturing cost.

Figure 22:
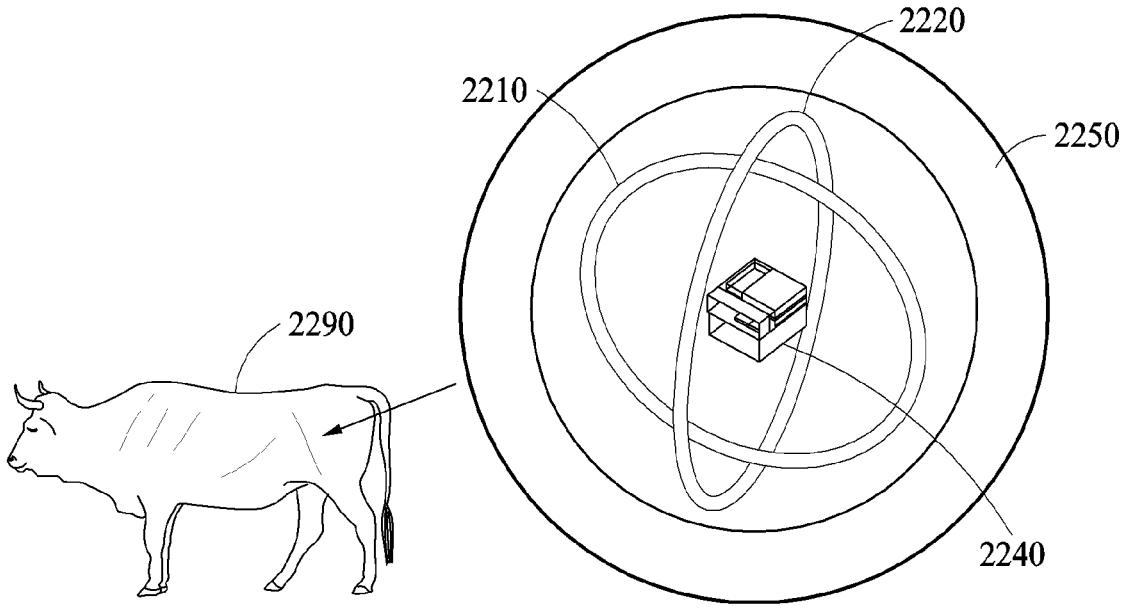
FIG. 22 is a diagram illustrating an example of a packaging case of an antenna device.

FIG. 22 is a diagram illustrating an example of a packaging case of an antenna device.

Referring to FIG. 22, an antenna device includes a first antenna element 2210, a second antenna element 2220, and a feeder 2240. In addition, the antenna device also includes a fixer 2250 to fix the first antenna element 2210, the second antenna element 2220, and the feeder 2240. The feeder 2240 may supply power to the first antenna element 2210 and the second antenna element 2220 using a mutual coupling through the structure illustrated in FIG. 21 without an additional connection. Through a mutual coupling between the first antenna element 2210 and the second antenna element 2220, power may be distributed to the first antenna element 2210 and the second antenna element 2220, and a phase difference may be generated between the first antenna element 2210 and the second antenna element 2220.

The feeder 2240 includes a communicator configured to form a mutual coupling with the first antenna element 2210 and to transfer a signal to the first antenna element 2210 through the mutual coupling. For example, the communicator may externally transmit sensing data collected from a living target 2290 through the first antenna element 2210 and the second antenna element 2220.

The fixer 2250 may fix an arrangement of each of the antenna elements 2210 and 2220, and the feeder 2240 using, for example, a filler and a frame structure. For example, the fixer 2250 may fix the communicator to a space corresponding to a center of the first antenna element 2210 and the second antenna element 2220.

The antenna element may be inserted in a body, for example, a stomach, of the living target 2290 as illustrated in FIG. 22. In an example, the antenna device may have a radiation pattern uniform in all directions, and thus receive a signal transmitted from an outside of the living target 2290 in a certain direction or transmit a signal outside. Thus, the antenna device may be embodied as an implantable device that may be inserted in a living target, for example, the living target 2290.

Figure 23:
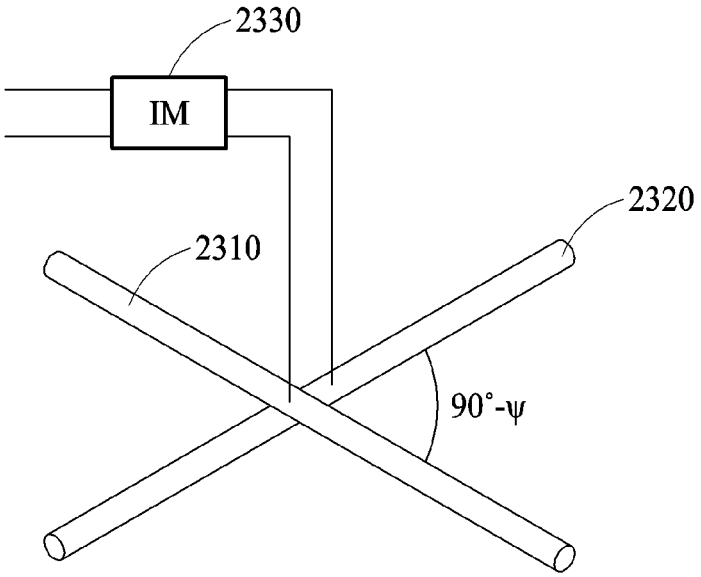
FIGS. 23 and 24 are diagrams illustrating examples of an arrangement of dipole-type antenna elements.
Figure 24:
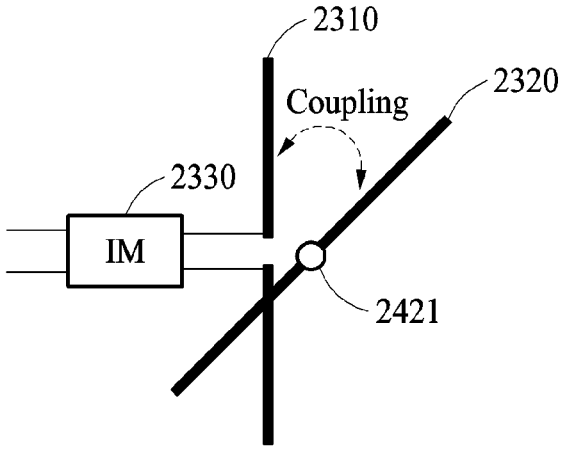

FIGS. 23 and 24 are diagrams illustrating examples of an arrangement of dipole-type antenna elements.

Referring to FIG. 23, a first antenna element 2310 and a second antenna element 2320 of an antenna device may be embodied as dipole-type antennas. The second antenna element 2320 may include an inductor as a reactance element. An IM 2330 may be connected to the first antenna element 2310.

The first antenna element 2310 and the second antenna element 2320 are arranged such that a central axis of the first antenna element 2310 and a central axis of the second antenna element 2320 form an angle, for example 90°−ψ, which is different than a right angle. A central axis of a dipole-type antenna element refers to an axis that passes through a center of a wire included in the dipole-type antenna element.

Referring to FIG. 24, the first antenna element 2310 and the second antenna element 2320 form a mutual coupling therebetween through the arrangement illustrated in FIG. 23. Here, the second antenna element 2320 is connected to a reactance element 2421 to form the mutual coupling with the first antenna element 2310. The reactance element 2421 may be, for example, an inductor.

Figure 25:
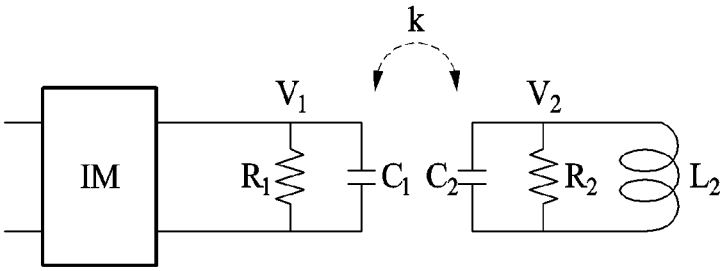
FIG. 25 is a diagram illustrating an example of an equivalent circuit of antenna elements arranged as illustrated in FIGS. 23 and 24.

FIG. 25 is a diagram illustrating an example of an equivalent circuit of antenna elements arranged as illustrated in FIGS. 23 and 24.

The antenna device illustrated in FIG. 24 may be construed as an equivalent circuit illustrated in FIG. 25. Referring to FIG. 25, $R_1$, $C_1$, and $V_1$ indicate a resistance of the first antenna element 2310, a capacitance of the first antenna element 2310, and a voltage applied to the first antenna element 2310, respectively. Also, $R_2$, $C_2$, and $V_2$ indicate a resistance of the second antenna element 2320, a capacitance of the second antenna element 2320, and a voltage applied to the second antenna element 2320, respectively. In addition, $L_2$ indicates an inductance of a reactance element connected to the second antenna element 2320, and k indicates a mutual coupling coefficient of the mutual coupling formed between the first antenna element 2310 and the second antenna element 2320. Equation 8 associated with the equivalent circuit illustrated in FIG. 25 may be represented as follows.

$$v_2\left(\frac{1}{R_2} + j\omega C_2 + \frac{1}{j\omega L_2}\right) + v_1 j\omega k\sqrt{C_1 C_2} = 0 \quad \text{[Equation 8]}$$

Equation 8 may also be expressed by Equation 9 based on a ratio of the voltages applied to the antenna elements 2310 and 2320.

$$\frac{V_2}{V_1} = \frac{j\omega k\sqrt{C_1 C_2}}{\frac{1}{R_2} + j\left(\omega C_2 - \frac{1}{\omega L_2}\right)} \quad \text{[Equation 9]}$$

In an example, for a dipole-type antenna element, a ratio of magnitudes of voltages of two antenna elements may be designed to be b and a phase difference may be designed to be 90° to form a uniform radiation pattern.

$$\frac{v_2}{v_1} = b\angle 90° \text{ at } \omega = \omega_0 = 2\pi f_0 \quad \text{[Equation 10]}$$

Based on Equation 9 and constraints of Equation 10, the mutual coupling coefficient k and the inductance $L_2$ of the reactance element may be derived as represented by Equation 11.

$$\begin{cases} k = \dfrac{b}{\omega_0 R_2\sqrt{C_1 C_2}} \\ L_2 = \dfrac{1}{\omega_0^2 C_2} \end{cases} \quad \text{[Equation 11]}$$

As represented by Equation 11 above, the mutual coupling coefficient k may be determined based on the voltage ratio b, a resonant frequency $w_0$, the resistance $R_2$ of the second antenna element 2320, the capacitance $C_2$ of the second antenna element 2320, and the capacitance $C_1$ of the first antenna element 2310. The inductance $L_2$ of the inductor included in the second antenna element 2320 may be determined based on the resonant frequency $w_0$ and the capacitance $C_2$ of the second antenna element 2320.

In an example, the angle formed between the central axis of the first antenna element 2310 and the central axis of the second antenna element 2320 is determined based on the mutual coupling coefficient k of Equation 11. For example, a mutual coupling coefficient for antenna elements may be derived from Equation 11, and an angle that satisfies the derived mutual coupling coefficient may be determined, through simulations, among angles formed between central axes of the antenna elements.

Figure 26:
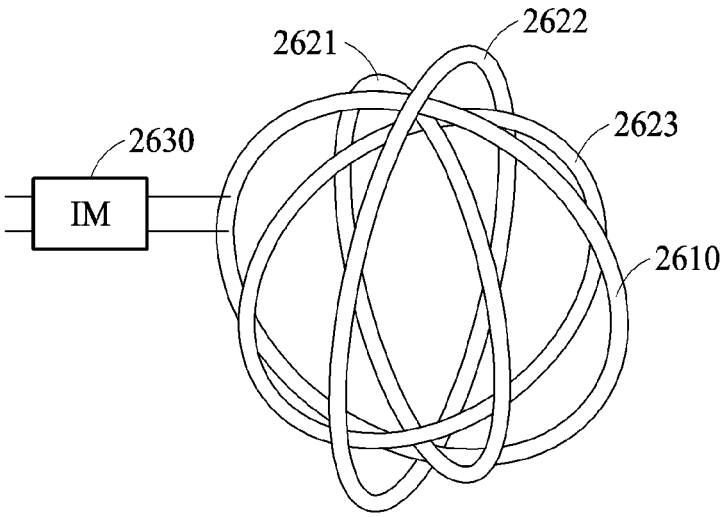
FIGS. 26 and 27 are diagrams illustrating an example of an antenna device including a main antenna element connected to a feeder and a plurality of sub antenna elements forming a mutual coupling with the main antenna element.
Figure 27:
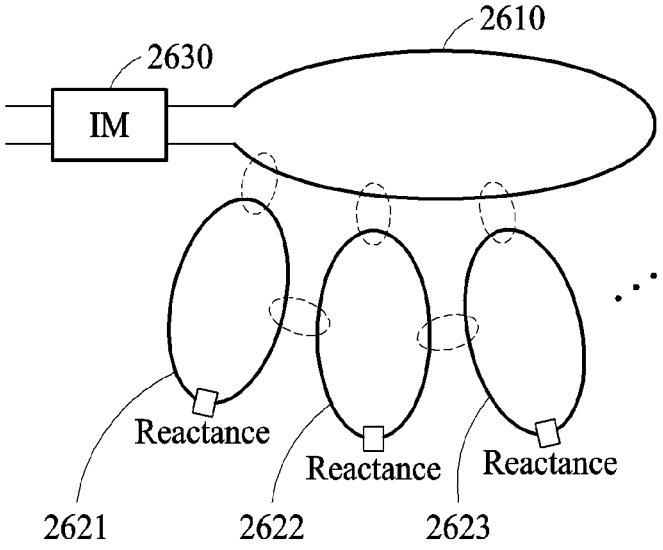

FIGS. 26 and 27 are diagrams illustrating an example of an antenna device including a main antenna element connected to a feeder and a plurality of sub antenna elements forming a mutual coupling with the main antenna element.

Referring to FIG. 26, a plurality of sub antenna elements 2621, 2622, and 2623 may correspond to a plurality of antennas arranged to form a mutual coupling with a main antenna element 2610. For example, as illustrated, the main antenna element 2610 is connected to an IM 2630, and the sub antenna elements 2621, 2622, and 2623 are arranged to form an angle different from a right angle with the main antenna element 2610. The first antenna element described above with reference to FIGS. 1 through 25 may correspond to the main antenna element 2610 of FIG. 26, and the second antenna element described above with reference to FIGS. 1 through 25 may correspond to the sub antenna elements 2621, 2622, and 2623 of FIG. 26.

Referring to FIG. 27, the main antenna element 2610 may form the mutual coupling with the sub antenna elements 2621, 2622, and 2623, and supply power to the sub antenna elements 2621, 2622, and 2623 through such a mutual coupling. In an example, each of the sub antenna elements 2621, 2622, and 2623 are connected to a reactance element.

In an example, the antenna device may generate a more uniform radiation pattern through a plurality of sub antenna elements. Although three sub antenna elements are illustrated in FIGS. 26 and 27, the number of sub antenna elements is not limited to the illustrative example.

Figure 28:
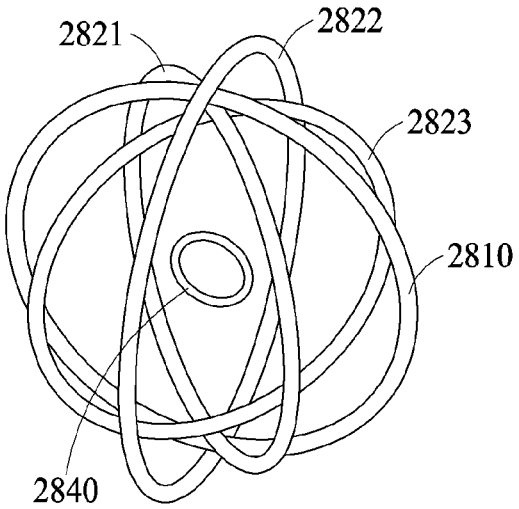
FIGS. 28 and 29 are diagrams illustrating an example of an antenna device including a plurality of antenna elements forming a mutual coupling with a feeder.
Figure 29:
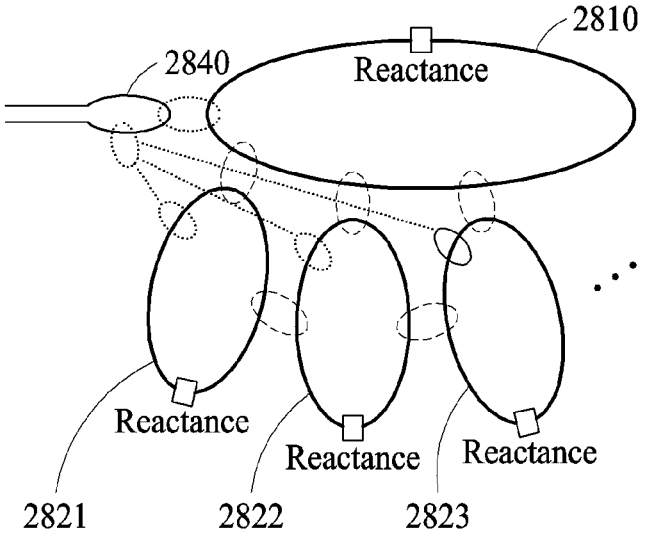

FIGS. 28 and 29 are diagrams illustrating an example of an antenna device including a plurality of antenna elements forming a mutual coupling with a feeder.

Referring to FIG. 28, an antenna device includes a main antenna element 2810 arranged on a plane on which a feeder 2840 is arranged, and a plurality of sub antenna elements 2821, 2822, and 2823 arranged to form an angle different from a right angle with the main antenna element 2810. The sub antenna elements 2821, 2822, and 2823 may be a plurality of antennas arranged to form a mutual coupling with the main antenna element 2810.

Referring to FIG. 29, the main antenna element 2810 illustrated in FIG. 27 may be connected to a reactance element, and receive power through a mutual coupling with the feeder 2840. Each of the sub antenna elements 2821, 2822, and 2823 may be connected to a respective reactance element, and receive power through the mutual coupling with the main antenna element 2810. In addition, the feeder 2840 may form a mutual coupling with at least one of the main antenna element 2810 or the sub antennas 2821, 2822, and 2823.

In an example, the antenna device may generate a more uniform radiation pattern through a plurality of sub antenna elements. Further, power may be distributed through a mutual coupling between a main antenna element and the plurality of sub antenna elements, without a physical connection therebetween. Although three sub antenna elements are illustrated in FIGS. 28 and 29, the number of sub antenna elements is not limited to the illustrative example.

Figure 30:
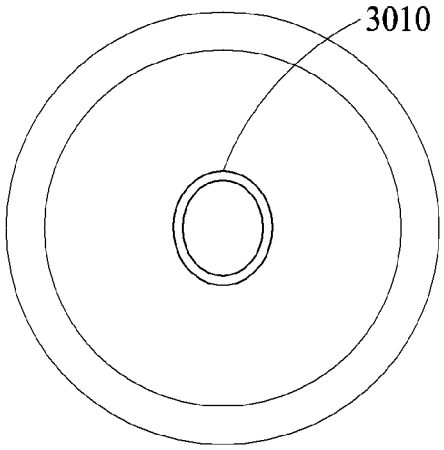
FIGS. 30 and 31 are diagrams illustrating an example of radiation by a single antenna element.
Figure 31:
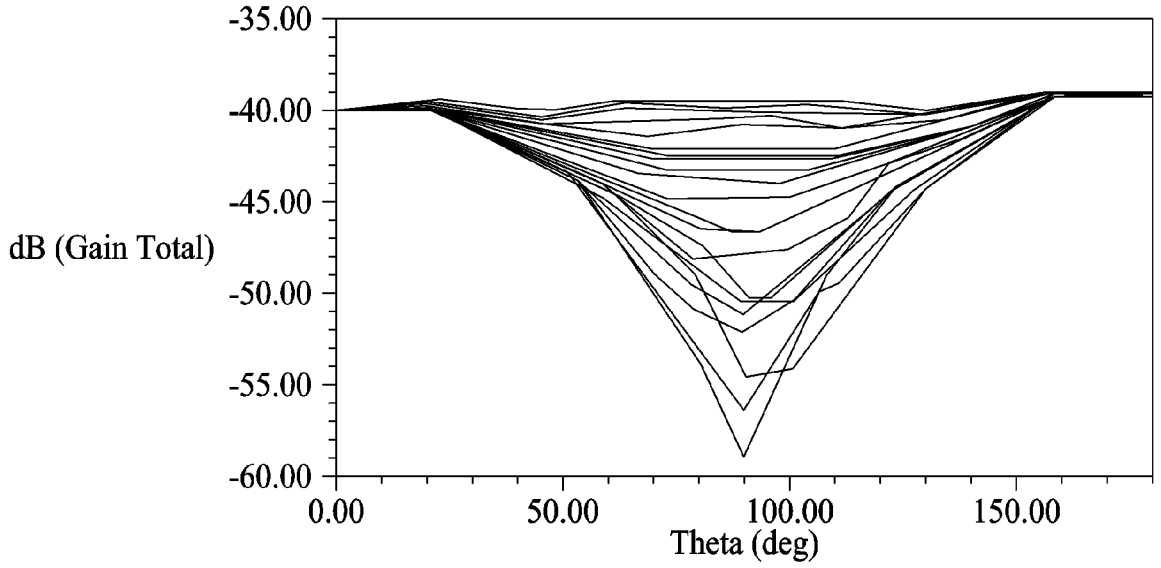

FIGS. 30 and 31 are diagrams illustrating an example of radiation by a single antenna element.

A loop-type single antenna element 3010 illustrated in FIG. 30 may be provided in a packaging case. The loop-type single antenna element 3010 may generate non-uniform or irregular radiation patterns as illustrated in FIG. 31. In a certain direction, for example, at a location at which theta is 90° as illustrated in FIG. 31, a radiation power difference exceeding 15 dB may be generated.

Figure 32:
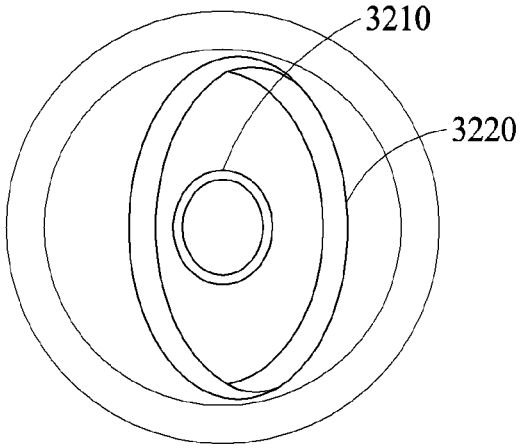
FIGS. 32 and 33 are diagrams illustrating an example of radiation by a main antenna element and a sub antenna element forming a mutual coupling with the main antenna element.
Figure 33:
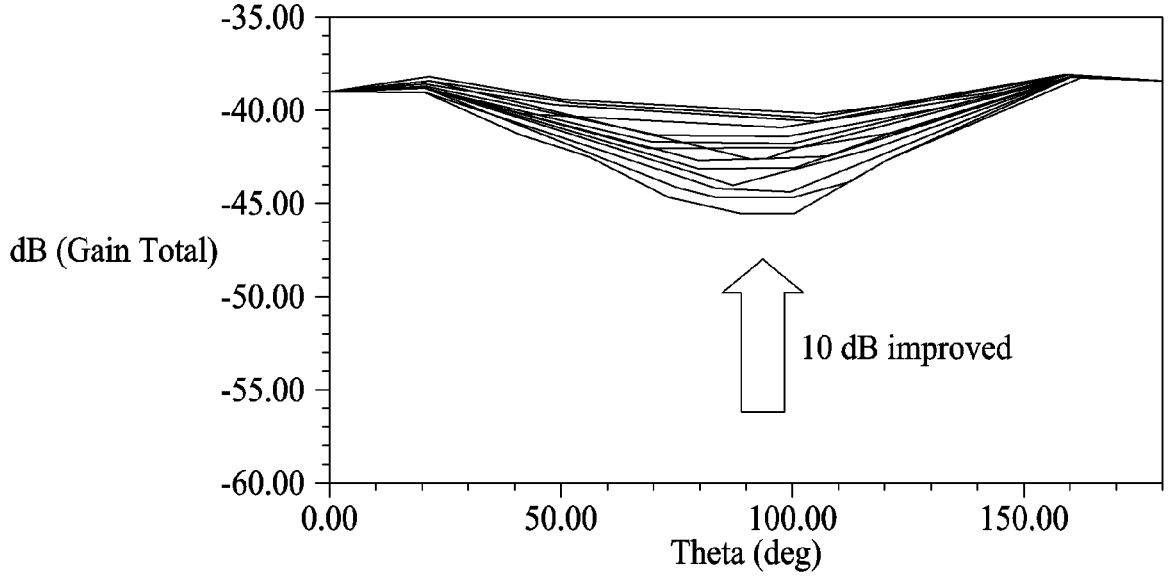

FIGS. 32 and 33 are diagrams illustrating an example of radiation by a main antenna element and a sub antenna element forming a mutual coupling with the main antenna element.

Referring to FIG. 32, a main antenna element 3210 and a sub antenna element 3220 may be arranged to form an angle different from a right angle therebetween. The main antenna element 3210 and the sub antenna element 3220 may be provided in a packaging case. An antenna device including the main antenna element 3210 and the sub antenna element 3220 may generate a uniform radiation pattern. For example, as illustrated in FIG. 33, the antenna device may improve a radiation power difference by approximately 10 dB from the radiation power difference illustrated in FIG. 31 in a certain direction, for example, at a location at which theta is 90° as illustrated in FIG. 33.

Figure 34:
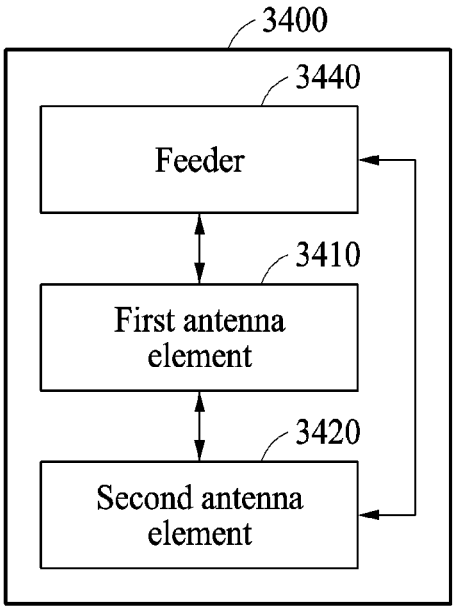
FIG. 34 is a diagram illustrating an example of an antenna device.

FIG. 34 is a diagram illustrating an example of an antenna device.

Referring to FIG. 34, an antenna device 3400 includes a first antenna element 3410, a second antenna element 3420, and a feeder 3440. The first antenna element 3410 may also be referred to as a main antenna element, and the second antenna element 3420 may also be referred to as a sub antenna element.

When power is supplied from the feeder 3440, the first antenna element 3410 may form a mutual coupling with the second antenna element 3420. The second antenna element 3420 may form the mutual coupling with the first antenna element 3410 through an arrangement in which a central axis of the second antenna element 3420 and a central axis of the first antenna element 3410 form an angle different from a right angle.

As described with reference to FIGS. 1 through 33, the first antenna element 3410 and the second antenna element 3420 may be arranged such that the central axis of the first antenna element 3410 and the central axis of the second antenna element form the angle different from the right angle therebetween. Through the mutual coupling, the first antenna element 3410 and the second antenna element 3420 may distribute power without a physical and direct connection therebetween. As represented by Equations 5, 7, and 11, a mutual coupling coefficient of the mutual coupling between the first antenna element 3410 and the second antenna element 3420 may be determined based on an impedance of the first antenna element 3410, a resistance of the second antenna element 3420, and an impedance of the second antenna element 3420.

In an example, the feeder 3440 supplies power to the first antenna element 3410. In an example, the feeder 3440 supplies power directly to the first antenna element 3410 through a wired connection. In an example, the feeder 3440 includes an IM to match the impedance of the first antenna element 3410. The IM may change the impedance of the first antenna element 3410. In another example, the feeder 3440 may be connected to the first antenna element 3410 through a mutual coupling, and supply power to the first antenna element 3410 through the mutual coupling.

Although a single first antenna element and a single second antenna element are illustrated in FIG. 34, the number of antenna elements is not limited to the illustrative example. As illustrated in FIGS. 26 through 29, the antenna device 3400 may include a plurality of antenna elements as the second antenna element 3420.

In an example, the antenna device 3400 may improve a reduction in transmitting and/or receiving performance that may occur due to a radiation power difference based on a direction of an antenna in wireless communication. The antenna device 3400 may be provided in, for example, a ultra-small wireless communication device that may be inserted in or attached to a living body, for example, a human body. The antenna device 3400 may also be provided in, for example, a ultra-small wireless communication device used in Internet of things (IoT).

While this disclosure includes specific examples, it will be apparent after an understanding of the present disclosure that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. An antenna device comprising:

a main antenna element configured to form a mutual coupling with a sub antenna element, in response to power being supplied to the main antenna element; and the sub antenna element being configured to form the mutual coupling with the main antenna element where a central axis of the sub antenna element forms an angle different from a right angle with a central axis of the main antenna element, and the angle being based on the mutual coupling coefficient for the main antenna element and the sub antenna element.

2. The antenna device of claim 1, wherein a plane on which the main antenna element is arranged and a plane on which the sub antenna element is arranged form an angle calculated based on a mutual coupling coefficient.

3. The antenna device of claim 2, wherein the mutual coupling coefficient is determined based on an impedance of the main antenna element, a resistance of the sub antenna element, and an impedance of the sub antenna element.

4. The antenna device of claim 1, wherein the main antenna element and the sub antenna element have the same resistance, reactance, and size, and the sub antenna element is configured to allow a current with a magnitude equal to a magnitude of a current flowing in the main antenna element to flow in the sub antenna element, in response to the mutual coupling with the main antenna element.

5. The antenna device of claim 1, wherein the main antenna element and the sub antenna element are arranged to prevent an electrical contact between the main antenna element and the sub antenna element.

6. The antenna device of claim 1, wherein the main antenna element and the sub antenna element are loop-type antennas.

7. The antenna device of claim 1, wherein the main antenna element and the sub antenna element are dipole-type antennas.

8. The antenna device of claim 1, wherein the sub antenna element comprises a plurality of antennas arranged to form the mutual coupling with the main antenna element.

9. The antenna device of claim 1, further comprising:

a feeder configured to supply power directly to the main antenna element through a wired connection.

10. The antenna device of claim 1, further comprising:

a feeder configured to supply power to the main antenna element through a mutual coupling.

11. The antenna device of claim 10, wherein the sub antenna element comprises antennas arranged to form the mutual coupling with the main antenna element, wherein the feeder is configured to form a mutual coupling with at least one of the main antenna element or the antennas.

12. The antenna device of claim 1, further comprising:

a communicator configured to form a mutual coupling with the main antenna element and to transfer a signal to the main antenna element through the mutual coupling; and a fixer configured to fix the communicator to a space corresponding to a center of the main antenna element and the sub antenna element.

13. The antenna device of claim 1, wherein the sub antenna element comprises:

a loop-type antenna; and a capacitor.

14. The antenna device of claim 13, wherein a capacitance of the capacitor is determined based on a resonant frequency of the mutual coupling formed between the main antenna element and the sub antenna element, and on an inductance of the loop-type antenna.

15. The antenna device of claim 13, wherein the capacitor is configured to allow a current with a phase delayed by 90° from a phase of a current flowing in the main antenna element to flow in the sub antenna element.

16. The antenna device of claim 1, wherein the sub antenna element comprises:

a dipole-type antenna; and an inductor.

17. The antenna device of claim 16, wherein an inductance of the inductor is determined based on a resonant frequency of the mutual coupling formed between the main antenna element and the sub antenna element, and on a capacitance of the dipole-type antenna.

18. The antenna device of claim 1, wherein the main antenna element comprises:

a first impedance matcher configured to change an impedance of the main antenna element.

19. The antenna device of claim 18, wherein the sub antenna element comprises:

a second impedance matcher configured to change an impedance of the sub antenna element.

20. The antenna device of claim 1, wherein the main antenna element is configured to generate a magnetic field in a first direction, and the sub antenna element is configured to generate a magnetic field in a second direction that is orthogonal to the first direction.

21. The antenna device of claim 1, wherein the central axis of the main antenna element corresponds to a normal vector of a plane on which the main antenna element is disposed.

22. The antenna device of claim 1, wherein the central axis of the sub antenna element corresponds to a normal vector of a plane on which the sub antenna element is disposed.

23. The antenna device of claim 1, further comprising a feeder configured to form a mutual coupling with at least one of the main antenna element or the plurality of the antennas.

24. An antenna device comprising:

a main antenna element configured to form a mutual coupling with a sub antenna element, in response to power being supplied to the main antenna element; and the sub antenna element being configured to form the mutual coupling with the main antenna element where a central axis of the sub antenna element forms an angle different from a right angle with a central axis of the main antenna element, wherein the sub antenna element is configured to allow a current with a phase delayed by 90° degrees from a phase of a current flowing in the main antenna element to flow in the sub antenna element, in response to the mutual coupling with the main antenna element.

25. An antenna device comprising:

a main antenna element configured to form a mutual coupling with each of a plurality of antennas, in response to power being supplied to the main antenna element;

the each of the plurality of antennas are connected to respective reactance components; and a central axis of the each of the plurality of antennas forms an angle different from a right angle with a central axis of the main antenna element, and the angle of the each of the plurality of antennas is based on the mutual coupling coefficient for the main antenna element and the respective antenna of the plurality of antennas, wherein the mutual coupling is based on the angle between the central axis of the respective antenna of the antennas and the central axis of the main antenna element and the reactance value of the reactance component of the respective antenna.

* * * * *